US006418702B2

(12) United States Patent
Wu et al.

(10) Patent No.: US 6,418,702 B2
(45) Date of Patent: Jul. 16, 2002

(54) STORAGE STABILIZED OXYGEN DEGRADABLE POLYMER

(75) Inventors: Chi-San Wu, Wayne; Laurence Senak, West Orange; Donna Osborne, Saddle River; James F. Curry; Charles B. Schriver, both of Wayne; Irwin B. Silverstein, Piscataway, all of NJ (US)

(73) Assignee: ISP Investments Inc., Wilmington, DE (US)

( * ) Notice: Subject to any disclaimer, the term of this patent is extended or adjusted under 35 U.S.C. 154(b) by 0 days.

(21) Appl. No.: 09/911,029

(22) Filed: Jul. 23, 2001

Related U.S. Application Data

(62) Division of application No. 09/153,943, filed on Sep. 16, 1998, now Pat. No. 6,331,333.

(51) Int. Cl.[7] ..... B65B 55/19
(52) U.S. Cl. ..... 53/474; 53/425
(58) Field of Search ..... 428/35.2, 35.4, 428/35.7; 53/425, 474

(56) References Cited

U.S. PATENT DOCUMENTS 4,287,995 A * 9/1981 Moriya ..... 215/228
4,396,734 A * 8/1983 Williams et al. ..... 507/221
5,392,590 A * 2/1995 Ambrose et al. ..... 53/111 RC
5,766,706 A * 6/1998 Cluster et al. ..... 215/35.2

* cited by examiner

*Primary Examiner*—Scott A. Smith
*Assistant Examiner*—Chukwurah H Nathaniel
(74) *Attorney, Agent, or Firm*—Marilyn J. Maue; William J. Davis; Walter Katz

(57) ABSTRACT

This invention concerns a stabilized packaging environment for a particulate vinyl lactam polymer, particularly polyvinylpyrrolidone particles, which comprises a sealed, oxygen-impervious receptacle containing the polymer particles and a separate air permeable package within the receptacle containing a water moistened oxygen scavenging agent, preferably iron powder, an iron (II) salt, ascorbic acid or a mixture of such agents.

7 Claims, No Drawings

STORAGE STABILIZED OXYGEN DEGRADABLE POLYMER

This is a division of application Ser. No. 09/153,943, filed on Sep. 16, 1998 is now U.S. Pat. No. 6,331,333.

BACKGROUND OF THE INVENTION

Polymers of vinyl pyrrolidones, particularly polyvinylpyrrolidone, are useful as inert carriers or fillers for various purity sensitive active chemicals. However, such polymers in powder form experience deterioration due to oxidation when exposed to air over extended periods of time. This is a serious consideration when the polymer is employed as a carrier for certain pharmaceutically active compounds or mixtures of compounds. For example, to meet specification for drugs, the amount of oxidized impurities, such as peroxide content, in the carrier must be maintained below 400 ppm.

High molecular weight polyvinylpyrrolidone (PVP) is especially valued as a carrier or filler for active components because of its hydrophobic/hydrophilic property which provides strong bonding and dispersability of the active ingredient. Further beneficial characteristics which set apart this homopolymer include water solubility, biodegradability and film leveling properties. Accordingly, the vinylpyrrolidone polymers have a wide field of application in the agrochemical, cosmetic and pharmaceutical arts. However, a major problem encountered in the extended storage of this polymer powder manifests itself in chain length deterioration caused by relatively small amounts of oxygen entrapped with the polymer during packaging. It has been found that packaged polymer, when stored for more than 6 months often undergoes a deterioration in K value from 95 to 85 or less, which significantly affects the viscosity of subsequent polymer solutions. The molecular weights of PVP have traditionally been characterized by K-value, which is related to relative viscosity (H. Fikentcher,Cellulose-Chem., 13,58 1932).

Accordingly, it is an object of this invention to overcome the above problem by providing a storage stable vinyl lactam polymer having oxygen containing impurities less than 300 ppm while maintaining a K-value similar to the initial polymer K-value.

Another object of the invention is to additionally provide a vinyl pyrrolidone polymer which retains all of its original desirable properties after storage for extended periods of time.

These and other objects of the invention will become apparent from the following description and disclosure.

THE INVENTION

In accordance with this invention there is provided a packaging environment for delivery of a stabilized, oxygen degradable particulate polymer which comprises said polymer sealed within a receptacle the walls of which have an atmospheric oxygen permeability of less than 3.5 cc/100 sq. inch/24 hr. for a 3 mil film and a water moistened oxygen scavenging agent-enclosed in at least one separate package or packet within said receptacle which package or packet is air permeable and is exposed to the atmosphere within said sealed receptacle.

The oxygen degradable polymer of the present invention is in particulate form, eg. as a powder, granule or flake and includes any polymer which is subject to at least partial oxidation, which is undesired for its ultimate use. Such polymers include N-vinyl lactam homo- and co-polymers and particularly polyvinylpyrrolidones (PVP) of varied molecular weights having a K value of from 12 to 150. The homopolymers of vinyl pyrrolidone having a high K value are subject to chain scission when exposed to oxygen over relatively short storage periods. For example, the K value of K 90 PVP, exposed to oxygen within a sealed container for a period of 180 days, can be as low as 85 or less.

The present polymer, when prepared for shipping or storing is generally sealed in an essentially gas impervious receptacle such as a plastic bag composed of a polyamide such as Nylon, polyester or ethylene/vinyl alcohol copolymer, vinyl chloride/vinyl-idene chloride copolymer such as Saran and the like having block, alternating or random structure. Such polymer receptacles are usually in the form of bags and have a gas permeability less than 3.5 cc/100 sq. inch/24 hr. for a 3 mil film. Poly(ethylene/vinyl alcohol) and Saran bags having an atmospheric oxygen permeability less than 0.1 cc/100 sq. inch/24 hrs.for a 3 mil film are preferred. The plastic containers may also include a metal foil or film lining or laminate to additionally insure against permeability of air. Generally the polymer receptacle is loosely filled with the particulate polymer to prevent tearing or bursting during handling and-shipment. Bags, ⅔ to 9/10 filled with polymer particles are recommended. Unavoidably, a given amount of air enters the polymer receptacle before sealing and the oxygen content entrapped therein is sufficient to cause deleterious oxidation of the polymer.

According to this invention, certain oxygen scavenging agents, containing a critical concentration of moisture are employed and are exposed to the atmosphere within the sealed receptacle but are separated from direct contact with the polymer particles. Direct contact of scavenger with the polymer is to be avoided in order to prevent polymer contamination and hence contamination of a subsequently formed polymer/active composition. This is accomplished by the use of one or more separate, air pervious packages containing the scavenging agent within the polymer receptacle The polymer containing package or packages may be integrally attached to an inner wall of the receptacle or may be freely or randomly distributed among the particles of polymer.

Suitable scavenging agents used to prevent degradation of the present polymer include ascorbic acid, iron powder, and an inorganic ferrous salt such as ferrous-halide, -nitrate or -sulfide. The scavenging agents employed herein critically contain 1 gram of water for every 1 to 100 grams of scavenger, preferably 1 gram of water/1.0 to 10 grams of scavenger and are thus employed in the form of a pliant consistency as in a paste, glue, soft wax or self-supporting cream.

Air contains about 20% oxygen by volume. The amount of scavenger employed depends on the oxygen content within the receptacle, between about 0.5 and about 1 gram of scavenger (iron powder)/liter of air is required to reduce polymer deterioration. Except for economic considerations, significantly larger amounts of scavenger, e.g. 10 grams of scavenger/liter of air can be employed, however such larger amounts of scavenger will not have any noticeable benefit in polymer stabilization.

Optionally, the scavenging agent composition used herein may additionally include a promoter to accelerate the oxygen reduction reaction. In this case, only a small amount, e.g. 1 part of promoter/200 parts of iron oxide, are employed; however, the use of up to 10 parts promotor/l part of scavenger is also within the scope of this invention. Suitable promoters include inorganic alkali and alkali earth metal salts of which the chloride, sulfide and nitrate of sodium or calcium are most desirable. Weak organic acids and bases such as acetic acid and triethanolamine promoters can also be employed as well as mixtures of the foregoing promoters if desired.

Having broadly described the present invention, reference is now made to the following examples which illustrate preferred embodiments but which are not to be construed as limiting to the scope of the invention as defined in the appended claims.

EXAMPLES 1–9

In the following examples 12 grams of polyvinylpyrrolidone K-90 were added to a 2 ounce jar having screwed cap closures with polyethylene liners. Each jar was tightly closed and contained 20 cc of air. The polymer samples were held at ambient temperature for the periods indicated after which the samples were recovered and the K-value and peroxide content of the polymer were immediately recorded. The jars of examples 1 and 2 were sealed without a packet of scavenging agent; whereas, in examples 3 to 9 each jar included an air pervious polyethylene plastic packet containing 2 grams of iron powder (Fe) or 5 grams of ascorbic acid (A) moistened with the indicated amount of water. In examples 8 and 9, 1 part of sodium nitrate promotor/200 parts of scavenger was added to the moist Fe powder. The results of polymer stability are reported in Table 1.

TABLE 1

| Example | Initial | Scavenger | Water | | K-value Days storage | | | | | | ppm Peroxides 150 days |
|---|---|---|---|---|---|---|---|---|---|---|---|
| # | K-value | /g. | g. | Promoter | 30 | 60 | 90 | 120 | 150 | 180 | Storage |
| 1 | 90.0 | — | — | — | 89.4 | 88.4 | 88.1 | 87.1 | 87.3 | 86.8 | 915 |
| 2 | 90.0 | — | — | — | 88.7 | 87.5 | 87.6 | 86.4 | 84.8 | 85.0 | 706 |
| 3 | 90.5 | Fe/2 | 0.5 | — | 90.5 | 90.3 | 89.3 | 90.6 | 89.1 | 90.1 | 353 |
| 4 | 90.5 | Fe/2 | 1.0 | — | 88.7 | 89.5 | 90.1 | 89.9 | 88.7 | 90.4 | 363 |
| 5 | 90.0 | Fe/2 | 0.5 | — | 90.1 | 90.2 | 88.2 | 87.7 | 90.0 | 90.3 | 169 |
| 6 | 90.0 | Fe/2 | 1.0 | — | 89.9 | 89.5 | 89.9 | 89.5 | 88.2 | 89.0 | 296 |
| 7 | 90.0 | A/5 | 1.0 | — | 89.6 | 89.2 | 88.6 | 88.8 | 87.9 | 88.4 | 273 |
| 8 | 90.0 | Fe/2 | 0.5 | $NaNO_3$ | 88.8 | 89.3 | 89.3 | 88.9 | 89.2 | 89.1 | 188 |
| 9. | 90.5 | Fe/2 | 0.5 | $NaNO_3$ | 90.1 | 90.1 | 89.9 | 90.0 | 90.1 | 90.2 | 203 |

Similar studies carried out at 50° C. provided similar beneficial results in avoiding peroxide formation and decrease in K-value as shown in following Table 2.

EXAMPLES 10–15

In each of the examples reported in the following Table, 2 grams of iron powder, 0.7 grams of water and sodium chloride (1/200 part/parts of iron powder) were placed inside a 2×3 Ziplock polyethylene bag (Bag samples A) and about 50 grams of polyvinyl pyrrolidone K-90 flakes were introduced into a separate 3×5 Ziplock polyethylene bag (bag samples B). In examples 12–15 a bag of each of types A and B were then introduced into an outer 6×8 packaging bag composed of the materials identified in Table 2 below. Examples 10 and 11 were used as controls where they contained only the Ziplock bag of type B and no scavenger. The outer packaging bags were sealed and placed in a 50° C. forced air oven. The polymer stability testing results are as reported in the following table.

TABLE 2

| Example # | Outer Storage bag material | Initial K-value | K-value after 2 weeks | Initial Peroxides | Peroxides after 2 weeks | Peroxides after 20 days | K-value after 1 month |
|---|---|---|---|---|---|---|---|
| 10 | PE[1] | 95.8 | 80.1 | 33 ppm | — | 705 ppm | — |
| 11 | PE[1] | 95.3 | 76.3 | 33 ppm | — | 800 ppm | — |
| 12 | multi-layer foil | 95.8 | 95.0 | 45 ppm | 77 ppm | 61 ppm | — |
| 13 | multi-layer foil | 95.3 | 94.0 | 45 ppm | — | 51 ppm | — |
| 14 | PE/EVOH/PE[2] | 91.8 | — | — | — | — | 92.0 |
| 15 | PE/Nylon/PE[3] | 91.8 | — | — | — | — | 92.0 |

[1]polyethylene
[2]poly(ethylene/ethyl vinyl alcohol/ethylene)
[3]poly(ethylene/Nylon/ethylene)

It will be understood that many modifications and substitutions can be made in the foregoing disclosure without departing from the scope of this invention. For example, the vinyl pyrrolidone polymer described can be substituted and extended to include other dry, oxygen sensitive polymers including unstabilized polypropylene, polyethers, polyurethane, polyethylene, and polyacrylonitrile.

What is claimed is:

1. The process of providing a storage stable oxidizable N-vinyl pyrrolidone polymer in particulate form having a K-value of 12–150 which comprises:

a). introducing said polymer into a sealable receptacle having an air permeability less than 3.5 cc/100 sq. inch/24 hrs./3 mil film;

b). introducing into an air permeable packet a sufficient oxygen reducing amount of an oxygen scavenging agent containing 1 gram of water/1 to 10 grams of scavenger agent sufficient to provide a scavenging agent in pliable consistency;

c). incorporating said packet containing into said sealable receptacle containing said vinyl pyrrolidone polymer for direct contact of the packet with said polymeric particles while avoiding contact of said particles with the oxygen scavenger and d). sealing said bag.

2. The process of claim 1 wherein said packet is integrally attached to a wall of said bag.

3. The process of claim 1 wherein at least one packet containing said scavenging agent is introduced into said bag and is intermingled with said polymer particles therein.

4. The process of claim 1 wherein said bag is ⅔ to 9/10 filled with said polymer particles.

5. The process of claim 1 wherein said polymer is a polymer of vinyl pyrrolidone having a k value of 12 to 150.

6. The process of claim 1 wherein said polymer is polyvinylpyrrolidone having a K-value of from 12 to 150.

7. The process of claim 1 wherein a plurality of packages are emplyoed and are sealed within said receptacle.

* * * * *